US012270110B1

(12) United States Patent
Jang

(10) Patent No.: US 12,270,110 B1
(45) Date of Patent: Apr. 8, 2025

(54) METHOD OF APPLYING NANO COATING TO STAINLESS STEEL

(71) Applicant: 2H PLUS Co., Ltd., Hanam-si (KR)

(72) Inventor: Ho Jae Jang, Hanam-si (KR)

(73) Assignee: 2H PLUS Co., Ltd., Hanam-si (KR)

( * ) Notice: Subject to any disclaimer, the term of this patent is extended or adjusted under 35 U.S.C. 154(b) by 0 days.

(21) Appl. No.: 18/911,816

(22) Filed: Oct. 10, 2024

(30) Foreign Application Priority Data

Jan. 3, 2024 (KR) ..... 10-2024-0000713

(51) Int. Cl.
*C23C 28/00* (2006.01)
*C25D 3/08* (2006.01)
*C25D 5/36* (2006.01)
*C25D 5/48* (2006.01)

(52) U.S. Cl.
CPC ..... *C23C 28/3455* (2013.01); *C25D 3/08* (2013.01); *C25D 5/36* (2013.01); *C25D 5/48* (2013.01)

(58) Field of Classification Search
CPC ..... C23C 28/3455; C25D 3/08; C25D 5/36; C25D 5/48
See application file for complete search history.

(56) References Cited

U.S. PATENT DOCUMENTS

2018/0030269 A1* 2/2018 Kim ..... C08J 7/046

FOREIGN PATENT DOCUMENTS

| | | | |
|---|---|---|---|
| JP | 06-228729 | A | 8/1994 |
| KR | 10-2018-0013388 | A | 2/2018 |
| KR | 10-2114851 | B1 | 5/2020 |
| KR | 10-2205514 | B1 | 1/2021 |
| KR | 10-2300834 | B1 | 9/2021 |
| KR | 10-2316998 | B1 | 10/2021 |

OTHER PUBLICATIONS

Written Decision on Registration issued Jun. 26, 2024 in Korean Patent Application No. 10-2024-0000713.
Request for the Submission of an Opinion issued Mar. 18, 2024 in Korean Patent Application No. 10-2024-0000713.

* cited by examiner

*Primary Examiner* — Nathan H Empie
(74) *Attorney, Agent, or Firm* — Sughrue Mion, PLLC

(57) ABSTRACT

Provided is a method of applying a nano coating to stainless steel including cleaning stainless steel; polishing the stainless steel with a nano abrasive composed of colloidal silica, nano-sized diamond particles, and ethylene glycol; immersing the stainless steel in a pickling solution composed of hydrochloric acid and containing an ionic liquid for 25 seconds; heat treating the surface of the stainless steel; applying a nano-coating agent composed of isopropyl alcohol, methylsilsesquioxane, siloxane, sulfuric acid, and distilled water to the surface of the stainless steel heat treated through the heat treatment step in an amount of 60 mg/m$^2$; curing the nano-coating agent applied on the surface of the stainless steel for 5 minutes; coating the surface of the stainless steel with a chromium mixture; and coating the surface of the stainless steel coated with the chromium mixture through the chromium mixture coating step with a finishing agent.

4 Claims, 1 Drawing Sheet

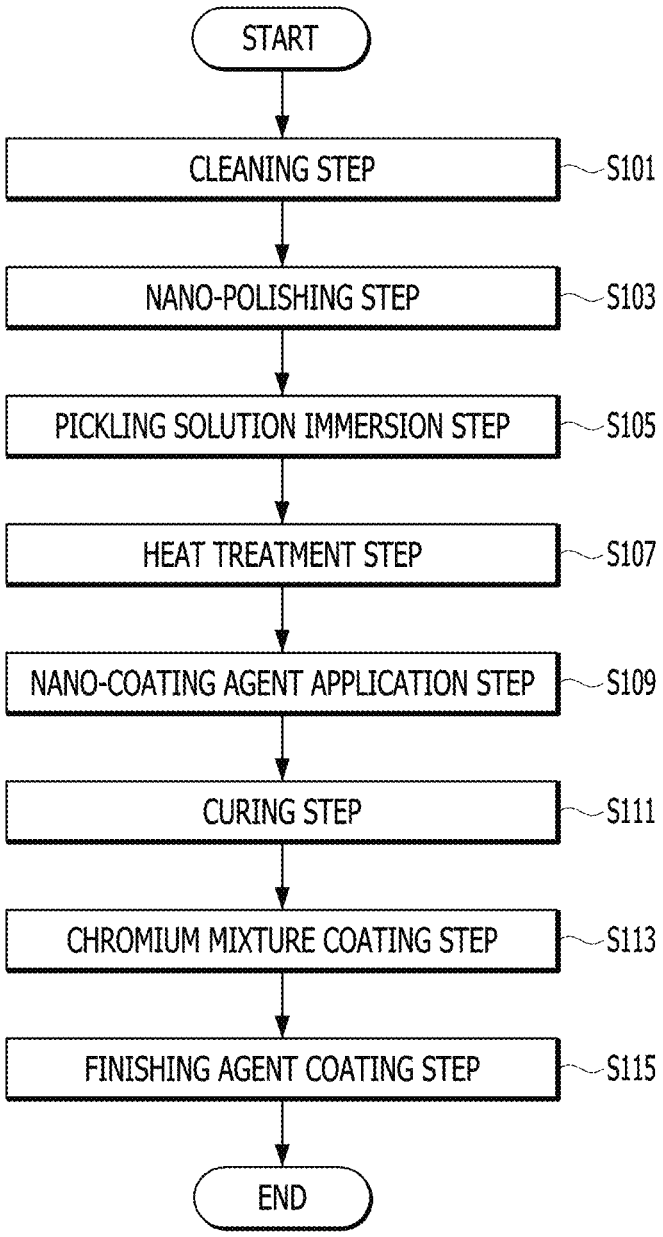
START
CLEANING STEP
S101
NANO-POLISHING STEP
S103
PICKLING SOLUTION IMMERSION STEP
S105
HEAT TREATMENT STEP
S107
NANO-COATING AGENT APPLICATION STEP
S109
CURING STEP
S111
CHROMIUM MIXTURE COATING STEP
S113
FINISHING AGENT COATING STEP
S115
END

METHOD OF APPLYING NANO COATING TO STAINLESS STEEL

CROSS-REFERENCE TO RELATED APPLICATION

This application claims priority to and the benefit of Korean Patent Application No. 10-2024-0000713, filed on Jan. 3, 2024, the disclosure of which is incorporated herein by reference in its entirety.

BACKGROUND

1. Field of the Invention

The present invention relates to a method of applying a nano coating to stainless steel, and more particularly, to a method which has a short processing time, maintains excellent gloss for a long time, improves antibacterial properties, scratch resistance, stain resistance and acid resistance, and provides stainless steel with self-resilience.

2. Discussion of Related Art

There are two types of steel sheet coating methods: the post-coating method, which involves coating a steel sheet after it is molded and processed, and the pre-coating method, which involves coating a steel sheet before it is molded and processed.

The post-coating method has low equipment costs and is advantageous for small-scale production, but it is difficult to produce uniform products and conduct mass production. In contrast, the pre-coating method allows the production of uniform products, reduces coating loss, and enables mass production in a short time.

Steel sheets coated through the pre-coating method are commonly called pre-coated metal (PCM) steel sheets, and the coating used for the pre-coating is called a PCM coating. The PCM steel sheet coated with the PCM coating described above undergoes a separate processing after coating.

Therefore, the PCM coating needs to satisfy conditions such as excellent processability, film hardness, adhesion, weather resistance, corrosion resistance, and curability.

Meanwhile, stainless steel is mainly used as a housing material for home appliances such as refrigerators, washing machines, and microwave ovens, and in particular, PCM coated steel sheets with a color coating on the stainless steel surface are widely used.

However, in the case of conventional PCM stainless steel coated steel sheets, the coating film is not transparent but translucent, and although they exhibit good gloss initially, the gloss decreases due to scratches or contamination during use, and bacteria or mold may grow in the cracks where scratches occur, or the surface may be contaminated due to water stains.

When stainless steel is hard coated with a hard coating agent to prevent gloss loss, contamination, or scratches, scratches occur easily and contaminants adhere to the scratches, reducing gloss and causing discoloration and hygiene problems due to proliferating bacteria.

In order to overcome these problems, a method of treating the surface of stainless steel with a glossy coating agent was conventionally used, but the coating agent had a long curing time of 7 to 9 hours after coating, and post-processing to remove residues had to be performed after the coating agent was applied.

PATENT DOCUMENTS (Patent Document 0001) Korean Registered Patent No. 10-2114851 (May 19, 2020)

(Patent Document 0002) Korean Registered Patent No. 10-2316998 (Oct. 19, 2021)

SUMMARY OF THE INVENTION

The object of the present invention is to provide a method of applying a nano coating to stainless steel which has a short processing time, maintains excellent gloss for a long time, improves antibacterial properties, scratch resistance, stain resistance, and acid resistance, and provides stainless steel with self-resilience.

The object of the present invention is achieved by providing a method of applying a nano coating to stainless steel, the method including a cleaning step of cleaning stainless steel; a nano-polishing step of polishing the stainless steel cleaned through the cleaning step with a nano abrasive composed of colloidal silica, nano-sized diamond particles, and ethylene glycol; a pickling solution immersion step of immersing the stainless steel polished through the nano-polishing step in a pickling solution composed of hydrochloric acid and containing an ionic liquid for 25 seconds; a heat treatment step of heat treating the surface of the stainless steel pickled through the pickling solution immersion step at a temperature of 300 to 400° C. using a 1200° C. torch; a nano-coating agent application step of applying a nano-coating agent composed of isopropyl alcohol, methylsilsesquioxane, siloxane, sulfuric acid, and distilled water to the surface of the stainless steel heat treated through the heat treatment step in an amount of 60 mg/m$^2$; a curing step of curing the nano-coating agent applied on the surface of the stainless steel through the nano-coating agent application step for 5 minutes; a chromium mixture coating step of coating the surface of the stainless steel coated with the nano-coating agent cured through the curing step with a chromium mixture in an amount of 5 to 50 mg/m$^2$; and a finishing agent coating step of coating the surface of the stainless steel coated with the chromium mixture through the chromium mixture coating step with a finishing agent in an amount of 20 to 40 mg/m$^2$, wherein the nano abrasive is prepared by adding 100 parts by weight of colloidal silica, 3 parts by weight of diamond particles with a particle diameter of 30 nm, and 45 parts by weight of ethylene glycol into a mixing stirrer, performing ultrasonic treatment for 12 minutes, and then stirring the mixture for 18 hours, the pickling solution is prepared by mixing 100 parts by weight of hydrochloric acid with a mass concentration of 60% and 17.5 parts by weight of trihexyltetradecylphosphonium chloride, the nano-coating agent is composed of 100 parts by weight of isopropyl alcohol, 15 parts by weight of methylsilsesquioxane, 17.5 parts by weight of siloxane, 0.55 parts by weight of sulfuric acid, and 17.5 parts by weight of distilled water, and the finishing agent is prepared by mixing 5 to 25 parts by weight of an inorganic mixture including ceramic powder with 100 parts by weight of an organic mixture including polyurethane methacrylate.

According to a preferred aspect of the present invention, the chromium mixture coating step is carried out by immersing the stainless steel coated with the nano-coating agent cured through the curing step in a chromium mixture and performing an electrolysis process at a temperature of 60 to 80° C. and a current density of 1 to 100 A/m$^2$.

According to a more preferred aspect of the present invention, the chromium mixture is composed of 100 parts by weight of sulfuric acid, 2 to 50 parts by weight of chromium trioxide, 1 to 20 parts by weight of acetic acid, and 0.01 to 1 part by weight of a nonionic surfactant.

According to a more preferred aspect of the present invention, the organic mixture including polyurethane is composed of 100 parts by weight of polyurethane methacrylate, 20 to 40 parts by weight of siloxane methacrylate, 1 to 3 parts by weight of a curing agent, and 50 to 100 parts by weight of a solvent.

According to a more preferred aspect of the present invention, the inorganic mixture including ceramic powder is composed of 100 parts by weight of isopropyl alcohol, 10 to 15 parts by weight of ceramic powder, 3 to 5 parts by weight of a thickener, 10 to 20 parts by weight of a silane coupling agent, and 15 to 25 parts by weight of purified water, and the ceramic powder is composed of titanium dioxide and silicon dioxide.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

The FIGURE is a flow chart illustrating a method of applying a nano coating to stainless steel according to the present invention.

DETAILED DESCRIPTION OF EXEMPLARY EMBODIMENTS

Hereinafter, preferred embodiments of the present invention and the physical properties of each component are described in detail. However, this detailed description is provided so that those skilled in the art can easily implement the invention, which does not mean that the technical idea and the scope of the present invention are limited thereto.

A method of applying a nano coating to stainless steel according to the present invention includes a cleaning step (S101) of cleaning stainless steel, a nano-polishing step (S103) of polishing the stainless steel cleaned through the cleaning step (S101) with a nano abrasive composed of colloidal silica, nano-sized diamond particles, and ethylene glycol, a pickling solution immersion step (S105) of immersing the stainless steel polished through the nano-polishing step (S103) in a pickling solution composed of hydrochloric acid and containing an ionic liquid, a heat treatment step (S107) of heat treating the stainless steel pickled through the pickling solution immersion step (S105), a nano-coating agent application step (S109) of applying a nano-coating agent composed of isopropyl alcohol, methylsilsesquioxane, siloxane, sulfuric acid, and distilled water to the surface of the stainless steel heat treated through the heat treatment step (S107), a curing step (S111) of curing the nano-coating agent applied on the surface of the stainless steel through the nano-coating agent application step (S109), a chromium mixture coating step (S113) of coating the surface of the stainless steel coated with the nano-coating agent cured through the curing step with a chromium mixture, and a finishing agent coating step (S115) of coating the surface of the stainless steel coated with the chromium mixture through the chromium mixture coating step (S113) with a finishing agent.

The cleaning step (S101) is for cleaning stainless steel to remove contaminants, powder, and dust remaining on the surface of the stainless steel.

In the cleaning step (S101), it is preferable to clean the surface of the stainless steel with a rotary polisher equipped with a sponge while spraying washing water on the surface of the stainless steel. When the rotary polisher equipped with a sponge is used, the efficiency of removing contaminants, powder, and dust remaining on stainless steel is increased, thereby improving the gloss of stainless steel.

The nano-polishing step (S103) is for polishing the stainless steel cleaned through the cleaning step (S101) with a nano abrasive composed of colloidal silica, nano-sized diamond particles, and ethylene glycol, and nano-sized fine grooves remaining on the stainless steel after the cleaning step (S101) are removed by polishing the stainless steel cleaned through the cleaning step (S101) with a nano abrasive.

The nano abrasive is preferably composed of 100 parts by weight of colloidal silica, 0.6 to 5 parts by weight of nano-sized diamond particles, and 40 to 50 parts by weight of ethylene glycol. When a nano abrasive composed of the above components is used, not only the surface of stainless steel has high roughness and becomes highly flat, but also the processing time of stainless steel may be shortened because polishing progresses quickly.

As the colloidal silica, it is preferable to use $SiO_2$-based abrasive grains with an average particle size of 50 to 80 nm in an alkaline solution including potassium hydroxide (KOH) and an amine-based solution ($NH_4OH$).

It is preferable to use nano-sized diamond particles with an average particle diameter distribution of 10 to 50 nm and an average particle diameter of 30 nm, and when stainless steel is polished using an abrasive including diamond particles with the above-described average particle diameter, the surface roughness of the stainless steel may be 3 Å or less and the flatness of the stainless steel may be 3 μm or less.

In addition, the ethylene glycol is used to maintain the stability of the abrasive by dispersing the nano-sized diamond particles in a colloidal silica solution but is not necessarily limited to the ethylene glycol, and other glycol-based materials may be used.

When the materials listed above are added to a mixing stirrer and mixed, it is preferable to treat the materials with ultrasonic waves for 5 to 20 minutes before mixing and stirring them for 12 to 24 hours. The reason for mixing the materials after irradiating them with ultrasonic waves is to ensure that nano-sized diamond particles are uniformly dispersed in colloidal silica.

The nano-polishing step (S103) may be performed using a conventional polishing device and a polishing pad, and more specifically, the nano abrasive and a lubricant are provided on the polishing pad while rotating the polishing pad to polish stainless steel with the nano abrasive.

The pickling solution immersion step (S105) is for immersing the stainless steel polished through the nano-polishing step (S103) in a pickling solution composed of hydrochloric acid and containing an ionic liquid, and it is preferable to immerse the stainless steel polished through the nano-polishing step (S103) in a pickling solution prepared by mixing 15 to 20 parts by weight of an ionic liquid with 100 parts by weight of hydrochloric acid for 20 to 30 seconds. Through the above process, scale remaining on the surface of the stainless steel may be efficiently removed without the use of nitric acid or hydrofluoric acid.

The ionic liquid is composed of one or more selected from the group consisting of trihexyl(tetradecyl)phosphonium chloride, methyltrioctylammonium chloride, and 1-butyl-3-methylimidazolium chloride, and when an ionic liquid composed of the above components is contained, the efficiency of dissolving scale remaining on the surface of stainless steel is improved, and thus oxidized scale on stainless steel may be removed in an environmentally friendly manner without the use of nitric acid or hydrofluoric acid. The oxidized scale on stainless steel may be removed at high speed by immersing the stainless steel in a pickling solution at room temperature rather than at a high temperature of 80° C. or higher, and the ionic liquid serves to exhibit a sufficient scale removal effect even when the mass concentration of hydrochloric acid is not high.

The heat treatment step (S107) is for heat treating the stainless steel pickled through the pickling solution immersion step (S105) and involves heating the stainless steel pickled through the pickling solution immersion step (S105) to 300 to 400° C.

The heat treatment step (S107) is preferably performed using a torch at about 1200° C. When the flame of a torch is applied to stainless steel for heat treatment, the temperature applied to the stainless steel is 300 to 400° C., and moisture, oil components, and foreign substances remaining on the surface of the stainless steel heat treated at the above temperature are removed.

When the heat treatment step (S107) is performed through the above process, the surface temperature of the stainless steel increases and the remaining moisture, oil components, and foreign substances are removed, and thus the coating effect of a nano-coating agent applied in the nano-coating agent application step (S109) is improved, and the curing time is reduced after the nano-coating agent is applied, thereby dramatically shortening the processing time.

The nano-coating agent application step (S109) is for applying a nano-coating agent composed of isopropyl alcohol, methylsilsesquioxane, siloxane, sulfuric acid, and distilled water to the surface of the stainless steel heat treated through the heat treatment step (S107), and a nano-coating agent composed of methylsilsesquioxane, siloxane, sulfuric acid, and distilled water is applied in an amount of 50 to 70 $mg/m^2$ to the surface of the stainless steel heated to a temperature of 300 to 400° C. through the heat treatment step (S107).

Typically, the amount of a coating agent applied to stainless steel is around 20 $mg/m^2$, but in the case of a nano-coating agent, since the particle size is small at tens of nanometers, the proportion of filling fine grooves on the surface of stainless steel is high, and thus it is desirable to use a large amount of a nano-coating agent compared to conventional coating agents.

When the amount of the applied nano-coating agent is less than 50 $mg/m^2$, a coating layer with a sufficient thickness is not formed, thereby leading to an insignificant effect of maintaining excellent gloss for a long time or improving antibacterial properties, scratch resistance, and stain resistance. When the amount of the applied nano-coating agent exceeds 70 $mg/m^2$, the above effect is not significantly improved and a coating layer with a uniform thickness is not formed, thereby degrading appearance quality and increasing processing costs.

The nano-coating agent is composed of 100 parts by weight of isopropyl alcohol, 10 to 20 parts by weight of methylsilsesquioxane, 10 to 25 parts by weight of siloxane, 0.5 to 0.6 parts by weight of sulfuric acid, and 10 to 25 parts by weight of distilled water, and a nano-coating agent composed of the above components not only removes oil and fat components remaining on the stainless steel, but also has a high filling effect in fine grooves on the stainless steel due to its nano-sized particles, thereby increasing the gloss of the stainless steel and exhibiting antibacterial properties, scratch resistance, and stain resistance.

The curing step (S111) is for curing the nano-coating agent applied on the surface of the stainless steel through the nano-coating agent application step (S109), and the nano-coating agent applied through the nano-coating agent application step (S109) is cured for 4 to 6 minutes.

Since the nano-coating agent applied through the nano-coating agent application step (S109) is applied to the stainless steel heated to a temperature of 300 to 400° C. through the heat treatment step (S107), the applied nano-coating agent exhibits excellent adhesion to the stainless steel, and the curing time may be significantly reduced to 4 to 6 minutes, compared to the conventional curing time of 5 to 10 hours, required after applying the nano-coating agent at room temperature.

When the curing time in the curing step (S111) is less than 4 minutes, the applied nano-coating agent is not completely cured, and when the curing time in the curing step (S111) exceeds 6 minutes, the curing process continues after completing the curing of the applied nano-coating agent, which is undesirable in terms of process efficiency.

The chromium mixture coating step (S113) is for coating the surface of the stainless steel coated with the nano-coating agent cured through the curing step (S111) with a chromium mixture, and the chromium mixture is preferably applied in an amount of 5 to 50 $mg/m^2$ to the surface of the stainless steel coated with the nano-coating agent cured through the curing step (S111).

More specifically, it is preferable to immerse the stainless steel coated with the nano-coating agent cured through the curing step (S111) in a chromium mixture and perform an electrolysis process at a temperature of 60 to 80° C. and a current density of 1 to 100 $A/m^2$. The electrolysis process is preferably performed under reverse pulse electrolysis conditions and involves a positive electrode electrolysis process and a negative electrode electrolysis process.

The stainless steel coated with the chromium mixture through the above process further improves corrosion resistance and chemical resistance. When the chromium mixture is applied in an amount of less than 5 $mg/m^2$, the above effect is insignificant, and when the chromium mixture is applied in an amount of more than 50 $mg/m^2$, it is undesirable in that the above effect is not significantly improved and bending occurs on the surface of the stainless steel, degrading appearance quality and significantly increasing manufacturing costs.

The chromium mixture is preferably composed of 100 parts by weight of sulfuric acid, 2 to 50 parts by weight of chromium trioxide, 1 to 20 parts by weight of acetic acid, and 0.01 to 1 part by weight of a nonionic surfactant.

The finishing agent coating step (S115) is for coating the surface of the stainless steel coated with the chromium mixture through the chromium mixture coating step (S113) with a finishing agent, and the finishing agent is preferably applied in an amount of 20 to 40 $mg/m^2$ to the surface of the stainless steel coated with the chromium mixture through the chromium mixture coating step (S113).

The stainless steel coated with the finishing agent through the above process has improved scratch resistance, suppresses the occurrence of scratches due to its resilience even when scratches occur, and exhibits self-resilience.

The finishing agent is preferably prepared by mixing 100 parts by weight of an organic mixture including polyurethane methacrylate with 5 to 25 parts by weight of an inorganic mixture including ceramic powder, and when the content of the inorganic mixture is less than 5 parts by weight, the matting and the viscosity increasing effects due to the inorganic composition are insignificant, making it difficult to uniformly coat the surface of the stainless steel with a finishing agent, and when the content of the inorganic composition exceeds 20 wt %, the fluidity of the coating agent decreases due to a rapidly increasing viscosity, thereby excessively reducing the efficiency of the coating process.

The organic mixture including polyurethane is preferably composed of 100 parts by weight of polyurethane methacrylate, 20 to 40 parts by weight of siloxane methacrylate, 1 to 3 parts by weight of a curing agent, and 50 to 100 parts by weight of a solvent, and an organic mixture composed of the above components exhibits excellent self-resilience.

The curing agent may be benzophenone, a ketone-based initiator, benzoic acid, anthraquinone, acylphosphine, etc., but is not limited thereto, and the solvent may be an aliphatic hydrocarbon solvent such as hexane, heptane, and methylene chloride, an aromatic hydrocarbon solvent such as benzene, toluene, pyridine, quinoline, anisole, mesitylene, and xylene, a ketone-based solvent such as methyl isobutyl ketone, 1 methyl-2-pyrrolidinone (NMP), cyclohexanone, and acetone, an ether-based solvent such as tetrahydrofuran (THF) and isopropyl ether, and an acetate-based solvent such as ethyl acetate, butyl acetate, and propylene glycol methyl ether acetate, but is not limited thereto.

The inorganic mixture including ceramic powder is composed of 100 parts by weight of isopropyl alcohol, 10 to 15 parts by weight of ceramic powder, 3 to 5 parts by weight of a thickener, 10 to 20 parts by weight of a silane coupling agent, and 15 to 25 parts by weight of purified water, and the ceramic powder is preferably composed of titanium dioxide and silicon dioxide. Ceramic powder composed of the above components serves to control the viscosity of the organic mixture and improve the scratch resistance of the finishing agent layer.

When the coating amount of the finishing agent is less than 20 mg/m$^2$, the scratch resistance or self-resilience of stainless steel is insignificant, and when the coating amount of the finishing agent exceeds 40 mg/m$^2$, it is undesirable in that the above effect is not significantly improved and the finishing agent is not uniformly applied, causing the surface bending on the stainless steel, and thus appearance quality may be degraded and manufacturing costs may be significantly increased.

Hereinafter, the method of applying a nano coating to stainless steel according to the present invention and the physical properties of stainless steel manufactured thereby will be described through the examples.

<Preparation Example 1> Preparation of Chromium Mixture

A chromium mixture was prepared by mixing 100 parts by weight of sulfuric acid, 25 parts by weight of chromium trioxide, 10 parts by weight of acetic acid, and 0.5 parts by weight of a nonionic surfactant.

<Preparation Example 2> Preparation of Finishing Agent

A finishing agent was prepared by mixing 100 parts by weight of an organic mixture including polyurethane methacrylate (100 parts by weight of polyurethane methacrylate, 30 parts by weight of siloxane methacrylate, 2 parts by weight of a curing agent, and 75 parts by weight of a solvent) with 15 parts by weight of an inorganic mixture including ceramic powder (100 parts by weight of isopropyl alcohol, 12.5 parts by weight of ceramic powder (including titanium dioxide and silicon dioxide mixed in a 1:1 weight ratio), 4 parts by weight of a thickener, 15 parts by weight of a silane coupling agent, and 20 parts by weight of purified water).

Example 1

The surface of stainless steel (STS304) was cleaned, and the cleaned stainless steel surface was polished with a nano abrasive (composed of 100 parts by weight of colloidal silica, 3 parts by weight of diamond particles with a particle diameter of 30 nm, and 45 parts by weight of ethylene glycol). The polished stainless steel was pickled by immersing it in a pickling solution (a mixture of 100 parts by weight of hydrochloric acid with a mass concentration of 60% and 17.5 parts by weight of an ionic liquid (trihexyltetradecylphosphonium chloride)) for 25 seconds, and the surface of the pickled stainless steel was heat treated at a temperature of 300 to 400° C. using a 1200° C. torch, and then the surface of the heat treated stainless steel was coated with a nano-coating agent (composed of 100 parts by weight of isopropyl alcohol, 15 parts by weight of methylsilsesquioxane, 17.5 parts by weight of siloxane, 0.55 parts by weight of sulfuric acid, and 17.5 parts by weight of distilled water) in an amount of 60 mg/m$^2$ and cured for 5 minutes. Afterward, the stainless steel coated with the nano-coating agent was immersed in the chromium mixture prepared in Preparation Example 1, and positive electrode and negative electrode electrolysis processes were performed under reverse pulse electrolysis conditions at a temperature of 70° C. and a current density of 50 A/m$^2$ to apply the chromium mixture at 25 mg/m$^2$. Subsequently, the surface of stainless steel coated with the chromium mixture was coated with the finishing agent prepared in Preparation Example 2 at 30 mg/m$^2$.

Example 2

Stainless steel was processed in the same manner as in Example 1, except that the stainless steel was coated with the chromium mixture in an amount of 5 mg/m$^2$ and the finishing agent in an amount of 20 mg/m$^2$.

Example 3

Stainless steel was processed in the same manner as in Example 1, except that the stainless steel was coated with the chromium mixture in an amount of 50 mg/m$^2$ and the finishing agent in an amount of 40 mg/m$^2$.

Comparative Example 1

Stainless steel (STS304)

Comparative Example 2

The surface of stainless steel (STS304) was cleaned, and the cleaned stainless steel surface was polished with a nano abrasive (composed of 100 parts by weight of colloidal silica, 3 parts by weight of diamond particles with a particle diameter of 30 nm, and 45 parts by weight of ethylene glycol). The polished stainless steel was pickled by immersing it in a pickling solution (a mixture of 100 parts by weight of hydrochloric acid with a mass concentration of 60% and 17.5 parts by weight of an ionic liquid (trihexyltetradecylphosphonium chloride)) for 25 seconds, and the surface of the pickled stainless steel was heat treated at a temperature of 300 to 400° C. using a 1200° C. torch, and then the surface of the heat treated stainless steel was coated with a nano-coating agent (composed of 100 parts by weight of isopropyl alcohol, 15 parts by weight of methylsilsesquioxane, 17.5 parts by weight of siloxane, 0.55 parts by weight of sulfuric acid, and 17.5 parts by weight of distilled water) in an amount of 5 mg/m$^2$ and cured for 5 minutes.

Comparative Example 3

Stainless steel was processed in the same manner as in Comparative Example 2, except that the stainless steel was coated with the nano-coating agent in an amount of 120 mg/m$^2$.

Comparative Example 4

Stainless steel was processed in the same manner as in Example 1, except that the stainless steel was coated with the chromium mixture in an amount of 1 mg/m$^2$ and the finishing agent in an amount of 40 mg/m$^2$.

Comparative Example 5

Stainless steel was processed in the same manner as in Example 1, except that the stainless steel was coated with the chromium mixture in an amount of 100 mg/m$^2$ and the finishing agent in an amount of 100 mg/m$^2$.

For the stainless steels processed in Examples 1 to 3 and Comparative Examples 1 to 3, antibacterial properties were measured, and results are shown in Table 1 below.

(For antibacterial properties, 12 hours after processing stainless steel, a film adhesion method was used to measure the number of bacteria at 37° C. after 24 hours, and *E. coli* ATCC25922 and *S. aureus* ATCC25923 were applied as test strains, and the number of bacteria was calculated by multiplying the number of bacteria on the medium by the dilution factor.)

TABLE 1

| Classification | | Example 1 | Example 2 | Example 3 | Comparative Example 1 | Comparative Example 2 | Comparative Example 3 |
|---|---|---|---|---|---|---|---|
| Strain | *E. Coli* | <10 | <10 | <10 | $1.28 \times 10^5$ | $1.02 \times 10^5$ | <10 |
| | *S. aureous* | <10 | <10 | <10 | $2.25 \times 10^5$ | $1.15 \times 10^5$ | <10 |

As shown in Table 1, it can be seen that the stainless steels manufactured in Examples 1 to 3 of the present invention exhibit excellent antibacterial properties. On the other hand, in Comparative Examples 1 and 2, it can be seen that the antibacterial properties are low because the stainless steels are not coated with the nano-coating agent or the amount of the applied nano-coating agent is too low.

The appearance quality of stainless steels manufactured in Examples 1 to 3 and Comparative Examples 1 to 5 was measured, and results are shown in Table 2 below.

(The appearance quality of stainless steel was measured by a method in which 20 test subjects visually check the gloss of the stainless steel surface and assess it using a 5-point scale, and an average value was obtained.

5 points: Excellent, 4 points: Good, 3 points: Average, 2 points: Bad, 1 point: Very bad The surface of the manufactured stainless steels was visually checked to see whether surface bending occurred.

○: Severe bending, Δ: Slight bending, x: No bending)

TABLE 2

| Classification | Example 1 | Example 2 | Example 3 | Comparative Example 1 | Comparative Example 2 | Comparative Example 3 | Comparative Example 4 | Comparative Example 5 |
|---|---|---|---|---|---|---|---|---|
| Gloss | 4.5 | 4.4 | 4.7 | 3.2 | 3.8 | 4.1 | 4.5 | 3.9 |
| Surface bending occurrence | × | × | × | × | × | Δ | × | ○ |

As shown in Table 2, it can be seen that the stainless steels manufactured in Examples 1 to 3 of the present invention have excellent gloss and no surface bending.

On the other hand, it can be seen that the stainless steels manufactured in Comparative Examples 1 and 2 have a relatively low gloss compared to Examples 1 to 3, and the stainless steels manufactured in Comparative Examples 3 and 5 have surface bending.

The scratch resistance and self-resilience of stainless steels manufactured in Examples 1 to 3 and Comparative Examples 1, 4 and 5 were measured, and results are shown in Table 3 below.

(Scratch resistance and self-resilience were measured by conducting a chipping test. More specifically, the test was performed by applying the same physical impact to the surface of stainless steel to cause a scratch and then measuring both the scratch size and the scratch size after 24 hours.)

TABLE 3

| Classification | Example 1 | Example 2 | Example 3 | Comparative Example 1 | Comparative Example 4 | Comparative Example 5 |
|---|---|---|---|---|---|---|
| Scratch size | 0.488 | 0.502 | 0.461 | 0.947 | 0.734 | 0.442 |
| Scratch size after 24 hours | 0.362 | 0.402 | 0.312 | 0.936 | 0.650 | 0.350 |

As shown in Table 3, it can be seen that the stainless steels manufactured in Examples 1 to 3 of the present invention exhibit excellent scratch resistance and self-resilience compared to the stainless steels manufactured in Comparative Examples 1 and 4.

Therefore, the method of applying a nano coating to stainless steel according to the present invention has a short processing time, maintains excellent gloss for a long time, improves antibacterial properties, scratch resistance, stain resistance and acid resistance, and provides stainless steel with self-resilience.

The method of applying a nano coating to stainless steel according to the present invention can have a short processing time, maintain excellent gloss for a long time, improve antibacterial properties, scratch resistance, stain resistance and acid resistance, and provide stainless steel with self-resilience.

DESCRIPTION OF SYMBOLS

S101: Cleaning step
S103: Nano-polishing step
S105: Pickling solution immersion step
S107: Heat treatment step
S109: Nano-coating agent application step
S111: Curing step
S113: Chromium mixture coating step
S115: Finishing agent coating step

What is claimed is:

1. A method of applying a nano coating to stainless steel, the method comprising:

a cleaning step of cleaning stainless steel;

a nano-polishing step of polishing the stainless steel cleaned through the cleaning step with a nano abrasive composed of colloidal silica, nano-sized diamond particles, and ethylene glycol;

a pickling solution immersion step of immersing the stainless steel polished through the nano-polishing step in a pickling solution composed of hydrochloric acid and containing an ionic liquid for 25 seconds;

a heat treatment step of heat treating the surface of the stainless steel pickled through the pickling solution immersion step at a temperature of 300 to 400° C. using a 1200° C. torch;

a nano-coating agent application step of applying a nano-coating agent composed of isopropyl alcohol, methylsilsesquioxane, siloxane, sulfuric acid, and distilled water to the surface of the stainless steel heat treated through the heat treatment step in an amount of 60 mg/m$^2$;

a curing step of curing the nano-coating agent applied on the surface of the stainless steel through the nano-coating agent application step for 5 minutes;

a chromium mixture coating step of coating the surface of the stainless steel coated with the nano-coating agent cured through the curing step with a chromium mixture in an amount of 5 to 50 mg/m$^2$; and a finishing agent coating step of coating the surface of the stainless steel coated with the chromium mixture through the chromium mixture coating step with a finishing agent in an amount of 20 to 40 mg/m$^2$, wherein the nano abrasive is prepared by adding 100 parts by weight of colloidal silica, 3 parts by weight of diamond particles with a particle diameter of 30 nm, and 45 parts by weight of ethylene glycol into a mixing stirrer, performing ultrasonic treatment for 12 minutes, and then stirring the mixture for 18 hours, the pickling solution is prepared by mixing 100 parts by weight of hydrochloric acid with a mass concentration of 60% and 17.5 parts by weight of trihexyltetradecylphosphonium chloride, the nano-coating agent is composed of 100 parts by weight of isopropyl alcohol, 15 parts by weight of methylsilsesquioxane, 17.5 parts by weight of siloxane, 0.55 parts by weight of sulfuric acid, and 17.5 parts by weight of distilled water, the finishing agent is prepared by mixing 5 to 25 parts by weight of an inorganic mixture including ceramic powder with 100 parts by weight of an organic mixture including polyurethane methacrylate, the inorganic mixture including ceramic powder is composed of 100 parts by weight of isopropyl alcohol, 10 to 15 parts by weight of ceramic powder, 3 to 5 parts by weight of a thickener, 10 to 20 parts by weight of a silane coupling agent, and 15 to 25 parts by weight of purified water, and the ceramic powder is composed of titanium dioxide and silicon dioxide.

2. The method of claim 1, wherein the chromium mixture coating step is carried out by immersing the stainless steel coated with the nano-coating agent cured through the curing step in a chromium mixture and performing an electrolysis process at a temperature of 60 to 80° C. and a current density of 1 to 100 A/m$^2$.

3. The method of claim 2, wherein the chromium mixture is composed of 100 parts by weight of sulfuric acid, 2 to 50 parts by weight of chromium trioxide, 1 to 20 parts by weight of acetic acid, and 0.01 to 1 part by weight of a nonionic surfactant.

4. The method of claim 1, wherein the organic mixture including polyurethane is composed of 100 parts by weight of polyurethane methacrylate, 20 to 40 parts by weight of siloxane methacrylate, 1 to 3 parts by weight of a curing agent, and 50 to 100 parts by weight of a solvent.

* * * * *